US009622608B1

(12) United States Patent
Worsham

(10) Patent No.: US 9,622,608 B1
(45) Date of Patent: Apr. 18, 2017

(54) ATHLETIC SHOEHORN

(71) Applicant: Jack W. Worsham, Greensboro, NC (US)

(72) Inventor: Jack W. Worsham, Greensboro, NC (US)

(73) Assignee: 21st Century Products, Inc., Greensboro, NC (US)

( * ) Notice: Subject to any disclaimer, the term of this patent is extended or adjusted under 35 U.S.C. 154(b) by 0 days.

(21) Appl. No.: 14/836,328

(22) Filed: Aug. 26, 2015

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82; A43B 11/02
USPC ..... D2/642
See application file for complete search history.

(56) References Cited

U.S. PATENT DOCUMENTS 1,500,928 A * 7/1924 Davis ..... A47G 25/82 223/118
D160,905 S * 11/1950 Tarrant ..... 223/118
3,088,639 A * 5/1963 Sexton ..... A47G 25/82 223/118
D196,293 S * 9/1963 Laitner ..... D4/116
D285,365 S * 8/1986 DeFlorio ..... D28/25
4,865,045 A 9/1989 Monreal
D382,686 S 8/1997 Litwin et al.
6,065,654 A * 5/2000 Evensen ..... A47G 25/82 223/112
6,474,518 B1 11/2002 Diaz-Acosta et al.
6,561,926 B2 * 5/2003 Hayashi ..... A63B 37/0003 473/372
2016/0199700 A1 * 7/2016 Kim ..... A63B 37/0022 473/378

* cited by examiner

*Primary Examiner* — Ismael Izaguirre
(74) *Attorney, Agent, or Firm* — Tuggle Duggins P.A.; Blake Hurt

(57) ABSTRACT

A shoehorn including an elongated blade defining a laterally extending arched geometry with lateral sides that are higher than the center portion and a substantially hollow handle defining a design feature selected by the user inspired by a favorite pastime such as golf, tennis, baseball, basketball, or other generally spherical members is provided. A method of producing a shoehorn including a handle feature inspired by a particular hobby of the user includes providing a polymeric material, injection molding the polymeric material into the shape of a blade as described above, and saving a significant amount of manufacturing material (at least 50%) by molding the handle feature with a substantially hollow center and about one half of the handle defining a plurality of cores therein is also provided.

16 Claims, 4 Drawing Sheets

ATHLETIC SHOEHORN

FIELD OF THE INVENTION

The invention herein pertains to shoehorns generally and particularly pertains to a shoehorn with a themed, injection molded feature which serves as a handle and is inspired by a particular hobby of the user.

DESCRIPTION OF THE PRIOR ART AND OBJECTIVES OF THE INVENTION

The use of a shoehorn to done high end foot attire is not novel, as the prior art is replete with examples of shoehorns all numerous shapes, sizes, and configurations. As is generally understood, the typical shoehorn is formed by an elongated blade member, usually defining a central curvature roughly approximating the geometry of the bottom of the foot and higher at the lateral edges than the center, and a handle of some size or geometry similar to or different from that of the blade (for example, see U.S. Pat. Nos. 4,865,045 and 6,474,518). The use of the shoehorn is not complex, as the device is usually inserted into a shoe, boot, or the like, followed by the foot of a user. The length and geometry of the blade assists in positioning and seating the foot appropriating within the shoe, boot, or the like, and then is removed via the handle without substantially displacing the foot. The use of a shoehorn is known to prevent wear on the rear of foot attire that, over time, may lead to the degradation and eventual failure of the material that makes up the upper heal of the shoe, boot, or the like.

The typical shoehorn is a utilitarian device, devoid of personality or character. The '518 patent to Diaz-Acosta noted above is a departure from the norm, in that it includes a decorated handle feature that sets it apart from the expected shoehorn design. It is not uncommon, particularly for adults, to own several sets of shoehorns, for example for use in locker rooms, club houses, and the like, but confusion with respect to the ownership of a particular shoehorn is a common occurrence. Therefore, there exists a need for a shoehorn that can be easily identified amidst a collection of similarly situated implements.

Thus, in view of the problems and disadvantages associated with prior art devices, the present invention was conceived and one of its objectives is to provide a shoehorn with a distinguishable handle feature.

It is another objective of the present invention to provide a polymeric shoehorn that is easy to use and efficient to manufacture while reducing the overall manufacturing materials needed.

It is still another objective of the present invention to provide a shoehorn formed by injection molding that includes a blade and a hobby-inspired handle feature.

It is yet another objective of the present invention to provide a shoehorn that includes a handle feature in the shape of a ball, such as a football, basketball, baseball, or golf ball.

It is a further objective of the present invention to provide a shoehorn with a handle feature in the shape of a ball that includes a plurality of cores defined within the ball.

It is still a further objective of the present invention to provide a handle feature in the shape of a ball that includes a plurality of cores of varying depths defined within the ball.

It is yet a further objective of the present invention to provide a method of forming a polymeric shoehorn including the steps of injection molding a handle feature in the shape of a ball, and defining a plurality of cores of varying depths within the ball to greatly reduce the amount of manufacturing materials needed to produce such a shoehorn.

Various other objectives and advantages of the present invention will become apparent to those skilled in the art as a more detailed description is set forth below.

SUMMARY OF THE INVENTION

The aforesaid and other objectives are realized by providing a shoehorn including an elongated blade defining a laterally extending arched geometry whereby the lateral sides of the blade are higher than the center portion. The blade is attached to a handle that provides a location to hold the shoehorn as the foot is being inserted into a shoe, boot, or the like. The handle defines a design feature selected by the user and may be inspired by a favorite pastime such as golf, tennis, baseball, basketball, soccer, or other generally spherical members. Each handle is substantially hollow, defining approximately half of the spherical handle with a generally solid exterior surface and the other half of the spherical handle defining a plurality of somewhat cylindrical cores extending the substantial radius of the respective half of the sphere defining the cores. A method of producing a shoehorn including a handle feature inspired by a particular hobby of the user includes providing a polymeric material, injection molding the polymeric material into the shape of a blade as described above, and saving a significant amount of manufacturing material (at least 50%) by molding the handle feature with a substantially hollow center and about one half of the handle defining a plurality of cores therein.

DETAILED DESCRIPTION OF THE PREFERRED EMBODIMENT AND OPERATION OF THE INVENTION

For a better understanding of the invention and its operation, turning now to the drawings, FIGS. 1-7 illustrate an embodiment of shoehorn 10 including blade 11 and handle 12. While described as separate components, it is contemplated that blade 11 and handle 12 may be integrally formed in one or more manners described below or as known in the art. Further, handle 12 is presented as a golf ball as will be described in greater detail below, but for the purpose of this disclosure, it should be understood that handle 12 may define the shape and characteristics (i.e. dimples, stitching, seams, and the like) of any generally spherical member such as a baseball, basketball, tennis ball, football, volleyball, soccer ball, pool ball, rugby ball, cricket ball, bowling ball, or fishing bobber. The following list is intended to be illustrative of the concept of the present invention, and is not intended to be an exhaustive or limiting recitation. Further, non-spherical embodiments of handle 12 are also contemplated, for example hockey pucks. Additional embodiments of handle 12 may include non-athletic inspiration, such as holiday ornaments, globes, or the like.

Figure 1:
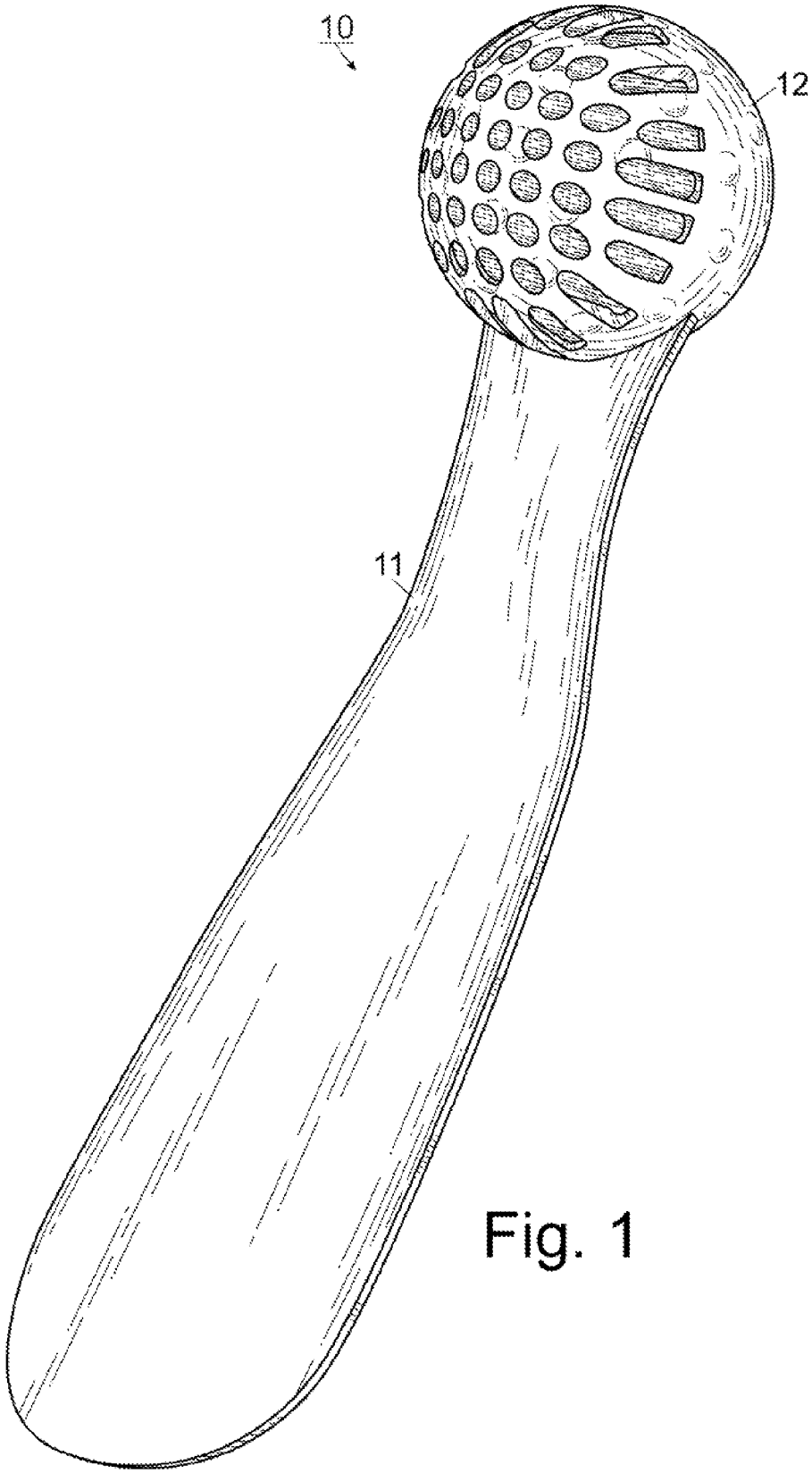
FIG. 1 shows a top, front, side perspective view of a shoehorn.
Figure 2:
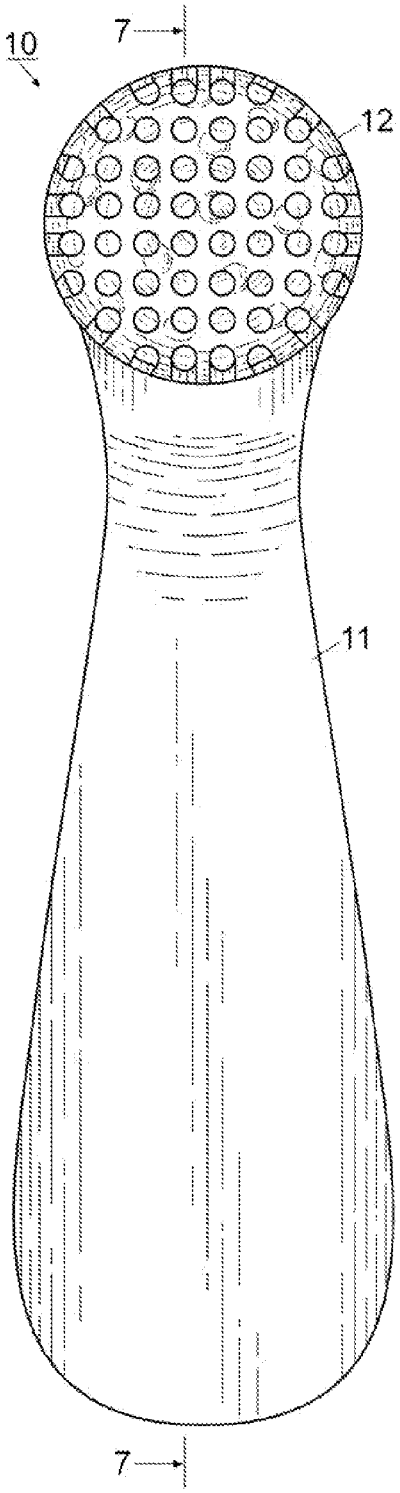
FIG. 2 pictures an elevated front view of the shoehorn of FIG. 1.
Figure 3:
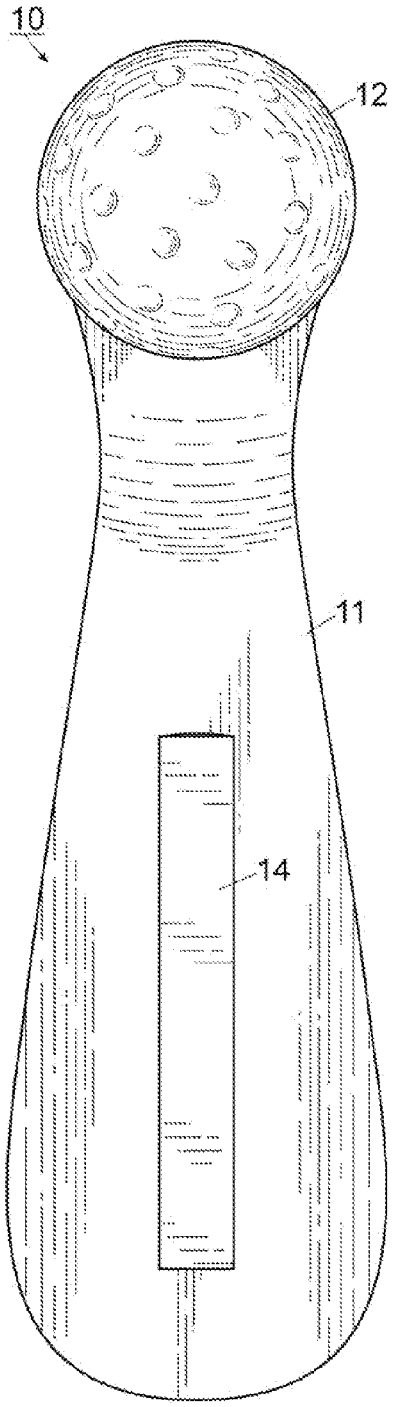
FIG. 3 depicts an elevated rear view of the shoehorn of FIG. 1.
Figure 4:
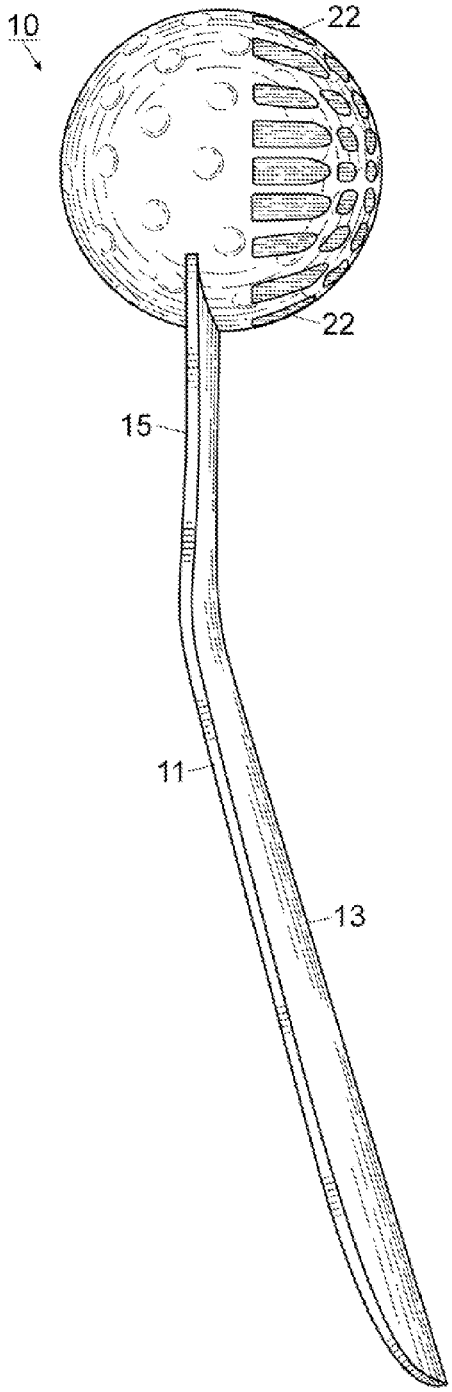
FIG. 4 features an elevated side view of the shoehorn of FIG. 1.
Figure 5:
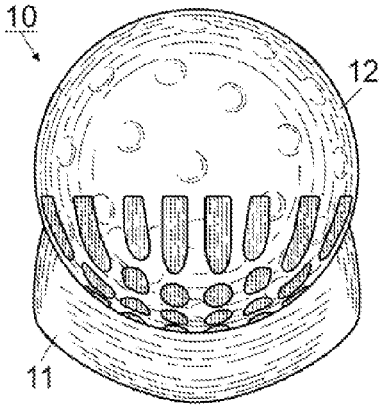
FIG. 5 demonstrates a top plan view of the shoehorn of FIG. 1.
Figure 6:
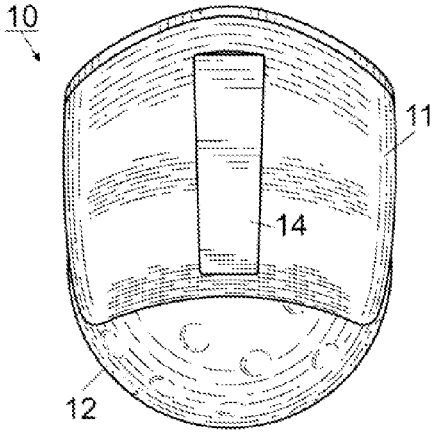
FIG. 6 illustrates a bottom plan view of the shoehorn of FIG. 1.

As best shown in FIGS. 4, 5 and 6, blade 11 is formed by a polymeric, generally elongated member 13 that guides the heel of the user (not shown) into place. To facilitate this action, elongate member 13 may define an arcuate cross-section (approximately twenty-five degrees) (25°) of rotation relative to the horizon), best visualized in FIG. 2, whereby the central section of elongate member 13 is located on a lower plane than the respective lateral sides of elongate member 13. To provide a more structurally robust shoehorn, elongate member 13 preferably includes planar rib 14 located on or in close approximation the longitudinal axis of elongate member 13 (not shown). An embodiment of planar rib 14 extends a length less than the length of elongate member 13, permitting a greater degree of flexion along the terminal radius of elongate member 13, for example to greater facilitate the ingress of a foot into a shoe and the comfortable removal of shoehorn 10.

Although elongate member 13 may connect directly with handle 12, preferred blade 11 further includes bridge 15 for attaching elongate member 13 to handle 12. In comparison to elongate member 13, which angles away from handle 12 on a descending plane, for example approximately twenty degrees (20°) downward, bridge 15 extends substantially straight outwardly on an approximately flat plane away from handle 12. The terms "substantially" and "approximately" are utilized as the geometry of bridge 15, in a lesser degree than elongate member 13, defines a slight curvature and therefore is not on a single plane extending from handle 12. In the preferred embodiment of shoehorn 10, bridge 15 extends along a first plane and elongate member 13 extends along a second, separate plane, which further facilitates the ease of ingress of the user's foot into a shoe and efficient removal of shoehorn 10 without displacement of the foot within the shoe, all without substantially distressing the shoe heel material. Further, while an embodiment of elongate member 13 may define a first width, an embodiment of bridge 15 may define a second, narrower width.

Figure 7:
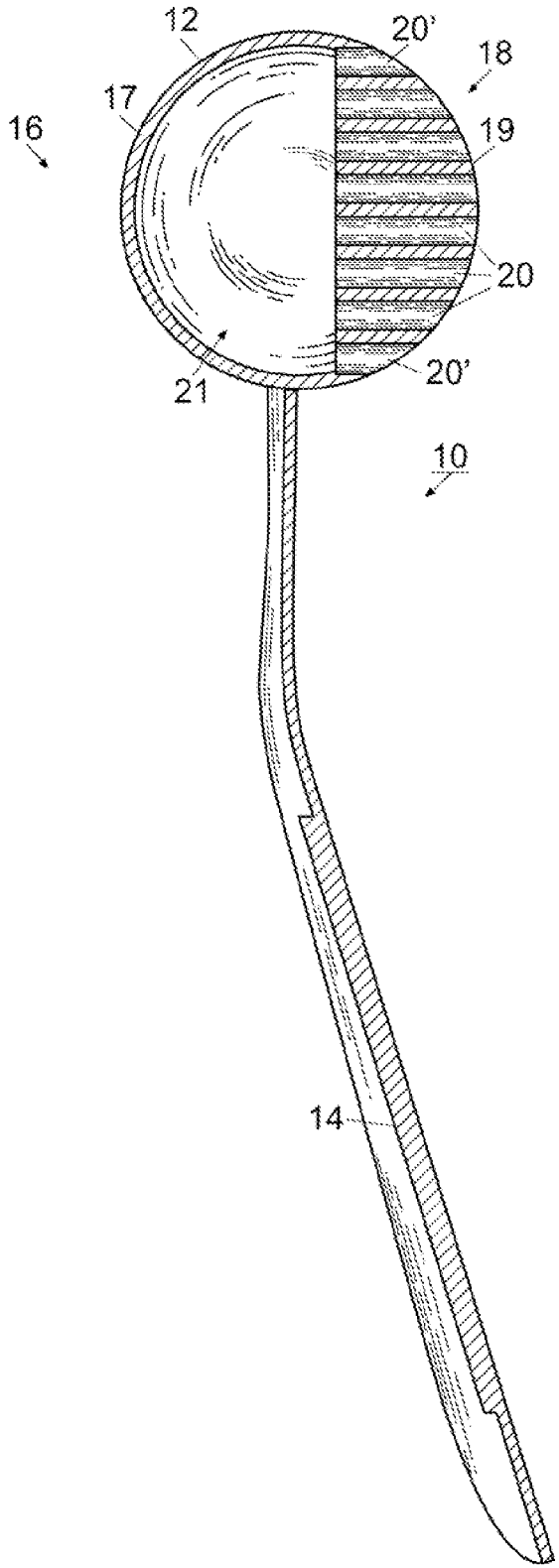
FIG. 7 shows an elevated cross-sectional view of the shoehorn taken along lines 7-7 of FIG. 2.

As further characterized in FIG. 7, handle 12 is formed from at least a first section 16 defining a continuous, that is to say substantially solid exterior surface 17 and at least a second section 18 defining a discontinuous exterior surface 19 with a plurality of cores 20 formed therein. As previously described, the illustrated embodiment of handle 12 defines a golf ball, and as such includes an array of dimples consistent with a conventional golf ball, and as understood other dimpling, stitching, channels, or the like to indicate other conventional ball surfaces could be formed on the outer surface of handle 12. Although described as separate structural components, it should be understood that first section 16 and second section 18 may be integrally formed, for example by an injection molding technique as described in further detail below. When combined, first section 16 and second section 18 define the exterior surface of handle 12, as well as large central void 21. In particular, first section 16 defines a generally hemispherical shape with no material necessary beyond that involved in forming solid exterior surface 17. By forming a large hollow space within handle 12, significant material volume, and therefore cost, can be saved in the production of shoehorn 10.

Cores 20 defined in discontinuous surface 19 are another way shoehorn 10 reduces material volume and cost. A plurality of cylindrical cores 20 preferably extend in a parallel orientation from a right angle radius dividing first section 16 and second section 18. In this context, an embodiment of the term "core" refers to a cylindrical aperture extending perpendicularly from the center of handle 12 through the exterior face of discontinuous surface 19. Additionally, an embodiment of second section 18 may further include one or more cores 20' that do not form a complete cylinder, as they are positioned on the peripheral circumference of handle 12, and therefore do not have a fully formed circumferentially extending wall. Embodiments of cores 20' may further include a beveled edge 22 formed in discontinuous surface 19. Depending on their respective location on discontinuous surface 19, cores 20 and 20' define a length that extend from approximately one third (⅓) the radial length of the hemispherical shape of second section 18 to the whole radial length of second section 18 and may either join with and be opened to void 21 or be closed therefrom. Embodiments of first section 16 and second section 18 may, or may not be equal, such that respective sections 16 and 18 may or may not define equal hemispherical sections.

A method of forming shoehorn 10 is also provided herein and includes providing a polymeric material appropriate for use in a conventional liquid injection plastic molding procedure such as polyethylene, polypropylene, polycarbonate, nylon, or other metals, glasses, elastomers, thermosets, and thermoplastics, as well as others copolymers and resin blends. The forms of blade 11 and handle 12 are molded together with bridge 15, and first handle section 16 is formed with central void 21 while second handle section 18 is formed with cores 20 and 20' in discontinuous exterior surface 19, producing a shoehorn that requires significantly less material, and therefore cost, to produce compared to the prior art. Further, forming handle 12 with central void 21 and cores 20, 20' results in a polymeric member that requires significantly less time to cure to produce a finished polymeric product. Given that the cost of operating an injection molding machine can often be priced down to a few seconds, designing a polymeric product that requires minutes less of curing time can realize cost savings even greater than those obtained by virtue of reduced material costs, and is a significant improvement over the prior art.

The illustrations and examples provided herein are for explanatory purposes and are not intended to limit the scope of the appended claims.

I claim:

1. A shoehorn comprising a blade and a spherical handle, the handle defining integral first and second sections, the first section defining a substantially solid exterior surface and the second section defining a discontinuous exterior surface in communication with a plurality of cores extending through the second section.

2. The shoehorn of claim 1 whereby the handle defines a hollow central void positioned within the spherical handle between the first and second handle sections.

3. The shoehorn of claim 1 whereby the blade defines an arcuate cross-section.

4. The shoehorn of claim 1 further comprising a bridge that connects the blade to the handle.

5. The shoehorn of claim 1 whereby the blade defines a planar rib.

6. The shoehorn of claim 1 whereby the handle defines the shape of a golf ball.

7. The shoehorn of claim 1 whereby the plurality of cores include one or more cylindrical apertures and one or more incomplete cylindrical apertures.

8. A method of forming a shoehorn comprising the steps of:

providing a polymeric material, molding a blade, molding a handle defining integral first and second sections, the first section defining a solid exterior surface, the second section defining a discontinuous surface in communication with a plurality of cores extending through the second section, and forming the blade to the handle.

9. The method of claim 8 whereby the step of molding the blade further comprises the steps of:

molding a blade with an arcuate cross-section, and defining a planar rib on the blade, the rib positioned or in close approximation to a longitudinal axis defined by the blade.

10. The method of claim 8 further comprising the steps of:

molding a bridge, and attaching the blade to the handle via the bridge.

11. The method of claim 10, further comprising the step of defining a first longitudinally extending plane relative to the bridge and a second longitudinally extending plane relative to the blade, the first plane different from the second plane.

12. The method of claim 8, whereby defining the discontinuous surface includes defining one or more cylindrical apertures and one or more incomplete cylindrical apertures.

13. The shoehorn of claim 1 wherein the first handle section defines a hemispherical shape.

14. The shoehorn of claim 5 wherein the blade defines an elongated member with a longitudinal axis and a first length, and wherein the rib is positioned or in close approximation to the longitudinal axis and defines a second length, and wherein the second length is less than that of the first length.

15. The shoehorn of claim 7 wherein the plurality of cores extend in a parallel orientation from a right angle radius dividing the first and second handle sections.

16. A shoehorn comprising an elongated blade defining an arcuate cross-section and a spherical handle the handle defining integral first and second sections, the first section defining a substantially solid exterior surface and the second section defining a discontinuous exterior surface in communication with a plurality of cores extending through the second section, wherein the discontinuous surface defines one or more cylindrical apertures and one or more circumferentially incomplete cylindrical apertures, wherein the plurality of cores extend in a parallel orientation from a right angle radius dividing the first and second handle sections, and wherein a hollow central void is formed between the first and second handle portions.

* * * * *